United States Patent [19]

Freund et al.

[11] Patent Number: 4,668,199

[45] Date of Patent: May 26, 1987

[54] IDLE EXHAUST RELIEF SYSTEM FOR OUTBOARD MOTORS

[75] Inventors: Michael A. Freund, Oshkosh; Paul H. Jennerjahn, Appleton; David W. Kusche, Oshkosh, all of Wis.

[73] Assignee: Brunswick Corporation, Skokie, Ill.

[21] Appl. No.: 808,136

[22] Filed: Dec. 12, 1985

[51] Int. Cl.[4] ..... B63H 21/34

[52] U.S. Cl. ..... 440/89; 60/272

[58] Field of Search ..... 440/76, 77, 88, 89, 440/900; 123/41.31, 195 P; 60/272

[56] References Cited

U.S. PATENT DOCUMENTS

| | | | |
|---|---|---|---|
| 3,045,423 | 7/1962 | Hulsebus | 60/32 |
| 3,198,162 | 8/1965 | Larsen | 440/89 |
| 3,310,022 | 3/1967 | Kollman | 115/17 |
| 3,350,879 | 11/1967 | Boda et al. | 60/31 |
| 3,577,952 | 5/1971 | Tado | 440/89 |
| 3,967,446 | 7/1976 | Harralson et al. | 60/312 |
| 4,354,849 | 10/1982 | Sanmi et al. | 440/88 |
| 4,421,490 | 12/1983 | Nakahama | 440/88 |
| 4,507,092 | 3/1985 | Hall et al. | 440/89 |

FOREIGN PATENT DOCUMENTS

| | | | |
|---|---|---|---|
| 185398 | 10/1983 | Japan | 440/89 |

*Primary Examiner*—Joseph F. Peters, Jr.
*Assistant Examiner*—Stephen P. Avila
*Attorney, Agent, or Firm*—O. T. Sessions

[57] ABSTRACT

An exhaust system for an outboard motor (10) includes a main exhaust passageway (16) extending through a partially water filled chamber (17) in the drive shaft housing (13). An inlet idle relief passage (23) connects the top of the chamber (17) with the main exhaust passageway (16) and an outlet passage (24) connects the top of the chamber (17) with the atmosphere. The system thus defines an effective exhaust silencer for the idle exhaust.

3 Claims, 4 Drawing Figures

IDLE EXHAUST RELIEF SYSTEM FOR OUTBOARD MOTORS

TECHNICAL FIELD

This invention relates to exhaust systems for outboard motors and particularly to an exhaust system providing an idle relief passage to accommodate exhaust at engine idle.

BACKGROUND ART

Outboard motors are generally designed to discharge exhaust from the engine downward through a genera11y hollow drive shaft housing and release the exhaust under water. During operation over most of the outboard motor's speed range, the exhaust is discharged at a low pressure region formed aft of the propeller. At idle and low speeds, however, the exhaust duct generally fills with water, necessitating an alternate path for exhaust flow. Examples of prior constructions which include exhaust relief systems are Hall et al, U.S. Pat. No. 4,507,092; Harrelson, U.S. Pat. No. 3,967,446; Boda et al, U.S. Pat. No. 3,350,879; Kollman, U.S. Pat. No. 3,310,022; and Hulsebus, U.S. Pat. No. 3,045,423.

While the prior systems are effective to relieve the exhaust pressure at low and idle speeds, it is generally desireable to provide a reduced level of exhaust noise at idle and low speed operation.

DISCLOSURE OF INVENTION

One of the objects of this invention is to provide an idle relief system with a reduced noise output. Another object of the invention is to provide such a system requiring a minimum of additional space. Yet another object of the invention is to provide an idle relief system which may readily be manufactured.

The foregoing objectives are achieved in an outboard motor having a water cooled internal combustion engine with an exhaust gas discharge opening and a drive shaft housing mounted below and supporting the engine. The drive shaft housing forms a chamber closed at the bottom with the chamber having a water outlet positioned to maintain the chamber partially filled with water. A main exhaust housing mounted in the drive shaft housing has a main exhaust passageway extending downward from the engine exhaust discharge opening. The main exhaust, passageway has a submerged outlet for discharging exhaust gas below water. A means is provided to introduce water into the chamber to assure the chamber is partially filled with water. To provide a silenced idle exhaust outlet, an inlet idle relief passage extends between the main exhaust passageway and the chamber, with the inlet idle relief passage connected to the chamber above the water outlet. An outlet idle relief passage connects between the chamber and the outside of the drive shaft housing. Thus the chamber above the water level serves as an integral part of the idle relief system.

Preferably the inlet and outlet idle relief passages extend generally horizontally at the top of the chamber. The inlet and outlet relief passages can thus conveniently be formed between the upper portion of the main exhaust housing and the lower portion of the engine.

The inlet and outlet relief passages can each include a reversal in direetion to both extend the passage lengths and provide further sound reduction.

Preferably both the inlet and outlet idle relief passages open into the chamber facing in the same direction to prevent direct transmission of sound across the chamber from the inlet to the outlet.

BEST MODE FOR CARRYING OUT THE INVENTION

Figure 1:
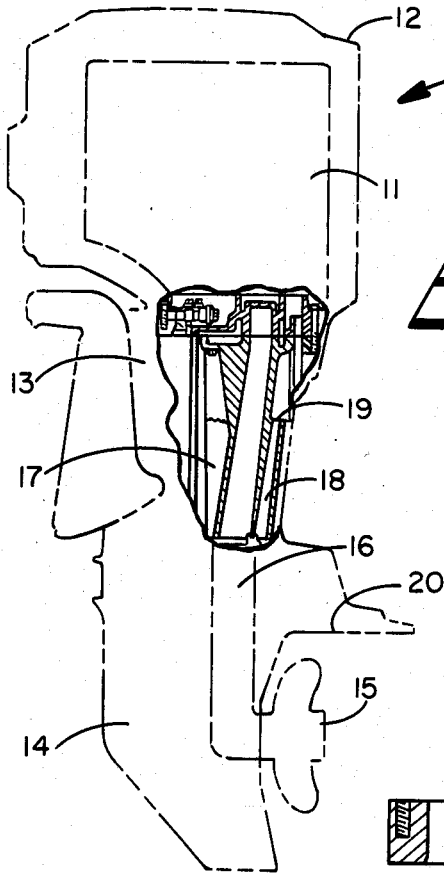
FIG. 1 is a partial sectional view of an outboard motor illustrating the invention.
Figure 2:
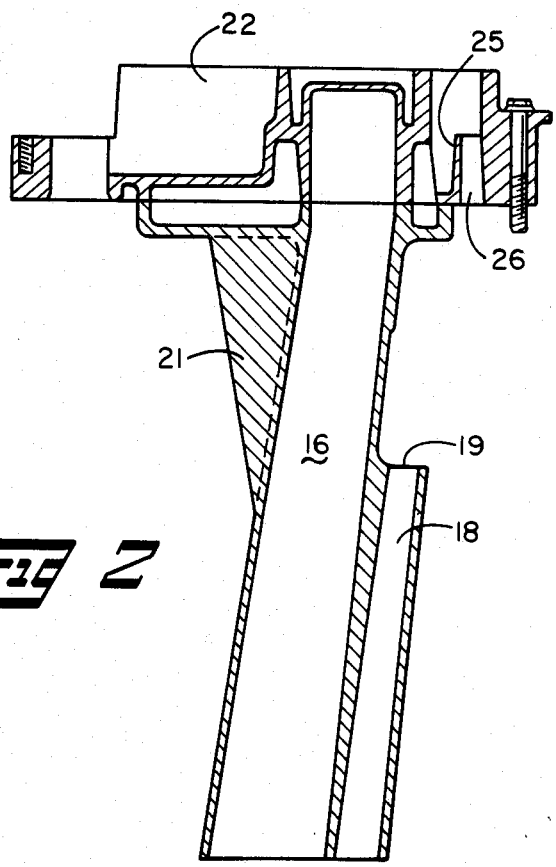
FIG. 2 is a sectional view of the lower portion of the engine and the main exhaust housing.
Figure 3:
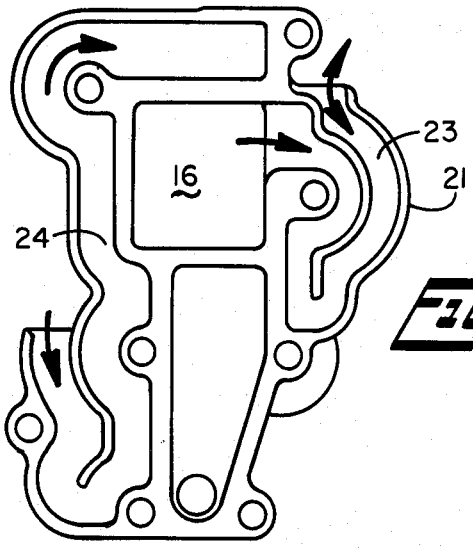
FIG. 3 is a top view of the main exhaust housing.
Figure 4:
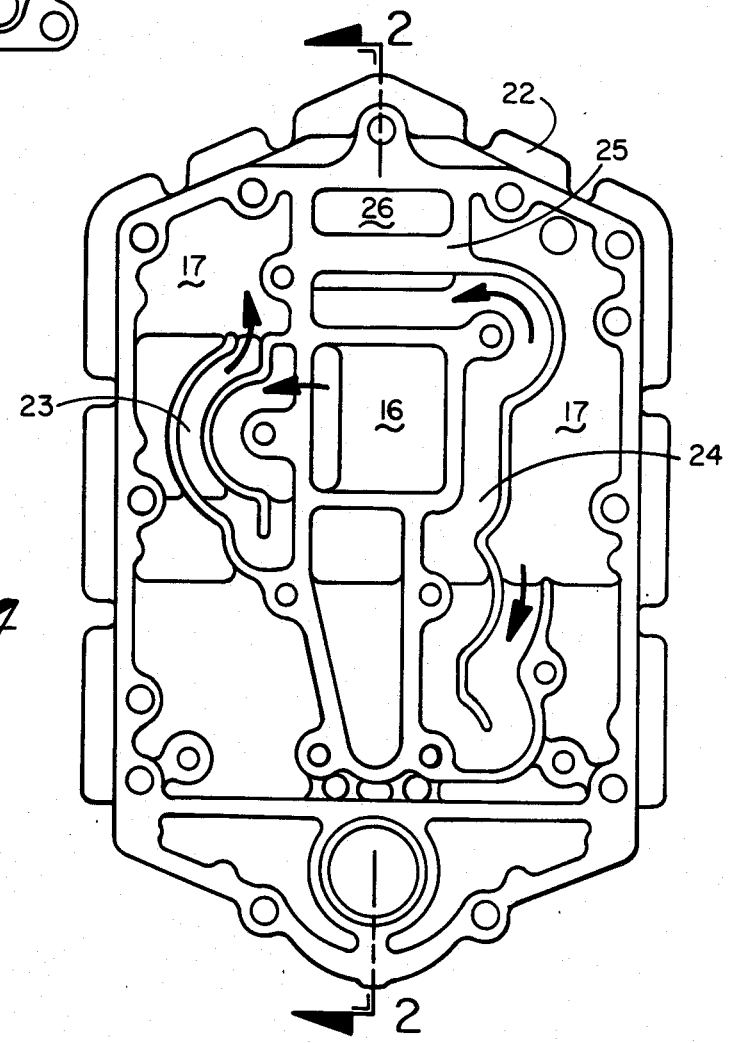
FIG. 4 is a bottom view of the engine.

Referring to the drawings, FIG. 1 shows an outboard motor 10 including an upper power head having an internal combustion engine 11 mounted within a cowl 12. The engine 11 and cowl 12 are supported on the upper end of a drive shaft housing 13 with a lower unit 14 carried at the bottom end of the drive shaft housing 13. A propeller 15 is supported by the lower unit 14 to be driven by a drive shaft, not illustrated, extending downward from the engine 11 through the forward portion of the drive shaft housing 13. The drive shaft is connected by gears to drive the propeller 15.

The engine 11 is a two cycle, crankcase compression engine of the type commonly used in outboard motors. An exhaust passage 16 is provided through the drive shaft housing to direct the engine's exhaust downward through the drive shaft housing and out the hub of the propeller 15 to normally discharge engine exhaust under water. In the drive shaft housing 13, the exhaust passage 16 is surrounded by a chamber 17. A water pump, not illustrated is provided to supply cooling water from the body of water in which the outboard motor 10 is operating to the engine 11. The chamber 17 is connected to receive the cooling water discharged from the engine 11 to maintain the chamber 17 partially filled with water. A water discharge passage 18, formed within the chamber 17 adjacent the exhaust passage 16, has an opening positioned 19 at a height to maintain the desired level of water in the chamber. The discharge passage 19 is connected at the bottom to discharge water through the lower unit 14.

The outboard motor 10 is normally mounted on a boat so that, at operating speeds, the water level will be at or below the anti-ventilation plate 20 on the lower unit 14 of the outboard 10. When the engine is idling and the boat is moving at low speeds or is stationary, however, the boat will normally sit considerably lower in the water and the water level will be somewhere substantially above the level of the anti-ventilation plate 20. Absent an alternate relief passage, considerable back pressure could arise in the main exhaust passageway 16 and negatively affect engine performance.

To prevent an elevated back pressure at low and idle speed conditions, and idle exhaust passageway is provided. The idle exhaust passageway is formed between a main exhaust housing 21 mounted in the drive shaft housing 13 and the adapter plate 22 which forms the lower end of engine 11. The adapter plate 22 and main exhaust housing 21 are formed by die casting, with die pulls in a vertical direction.

The idle relief passageway includes an inlet passage 23 formed between the adapter plate 22 and the main exhaust housing 21. The inlet passage 23 opens into the main exhaust passageway 16 in the main exhaust housing 21, extends forward along the main exhaust passageway 16, and turns aft to provide an extended tortuous passage between the main exhaust passageway 16 and the upper portion of chamber 17. The idle exhaust is thus discharged from the main exhaust passageway 16 into the upper portion of the chamber 17 above the water level in the chamber 17. From the chamber 17, an idle exhaust outlet passage 24, formed between the adapter plate 22 and main exhaust housing 21, is provided. The idle exhaust outlet passage 24 opens from the chamber 17 and extends forward to the forward part of the drive shaft housing 13, turns, and extends aft along the main exhaust passageway 16. Aft of the main exhaust passageway 16, the idle outlet passage turns behind the main exhaust passageway 16. A baffle 25, formed in the adapter plate 22 aft of the main exhaust passageway, first directs the exhaust flow upward against the bottom of the engine cylinder block and then discharges the idle exhaust downward through an outlet 26 at a central location aft of the main exhaust passageway 16. The inlet and outlet exhaust passages 23 and 24 have approximately the same cross-sectional area, sized to eliminate any significant restriction at engine idle.

The inlet and outlet idle exhaust gas passages 23 and 24 are placed on opposite sides of the main exhaust housing 21. Both open into the chamber 17 in and aft facing direction to prevent direct transmission of sound waves across the chamber 17 from the inlet passage 23 to the outlet passage 24. The chamber 17 above the water surface thus serves as highly effective acoustical expansion chamber for the idle relief system. The size of the acoustical chamber is controlled by the elevation of the discharge opening 19 to the water discharge passage.

The foregoing arrangement provides a highly effective muffler for the idle relief system without significantly degrading the effect of the water jacket provided around the main exhaust passageway 16. The muffler makes extremely effective use of the limited space available by utilizing the upper portion of the water jacket chamber 17 to provide an idle exhaust expansion chamber. Further, the idle relief system can readily be formed by the use of die cast parts.

We claim:

1. An outboard motor comprising:

(A) a water-cooled internal combustion engine having an exhaust gas discharge opening;

(B) a drive shaft housing mounted below and supporting said engine, said housing forming a chamber closed at the bottom, said chamber having a water outlet positioned to maintain said chamber partially filled with water;

(C) a main exhaust housing mounted in said drive shaft housing and having a main exhaust passageway extending downward from said exhaust discharge opening, said main passageway having a submerged outlet for discharging exhaust gas below water;

(D) means for introducing water into said chamber;

(E) an inlet idle relief passage extending between said main exhaust passageway and said chamber, said inlet idle relief passage positioned entirely above said water outlet;

(F) an outlet idle relief passage connected between said chamber and the outside of said drive shaft housing, said outlet relief passage positioned entirely above said water outlet; and wherein said inlet and outlet relief passages are formed between the lower portion of said engine and said main exhaust housing and extend generally horizontally at the top of said chamber and wherein each of said inlet and outlet relief passages includes a reversal in direction.

2. The outboard motor defined in claim 1 wherein said inlet and outlet idle relief passages are positioned on opposite sides of said main exhaust passageway.

3. The outboard motor defined in claim 2 wherein said inlet and outlet idle relief passages both have openings into said chamber, said openings facing the same direction whereby sound waves traversing said chamber from said inlet passage to said outlet passage will be forced through a reversal in direction.

* * * * *